United States Patent [19]

Friedlander et al.

[11] 4,360,027

[45] Nov. 23, 1982

[54] THIN, LIGHT-WEIGHT FLEXIBLE ORTHOPEDIC DEVICE

[76] Inventors: Bruce Friedlander, 129 Joralemon St., Brooklyn, N.Y. 11201; Steven E. Samet, 232 Washington Ave., Brooklyn, N.Y. 11205

[21] Appl. No.: 278,605

[22] Filed: Jun. 29, 1981

[51] Int. Cl.[3] ..... A61F 5/14

[52] U.S. Cl. ..... 128/581; 128/615

[58] Field of Search ..... 128/80 R, 581, 586, 128/614, 615

[56] References Cited

U.S. PATENT DOCUMENTS

| | | | |
|---|---|---|---|
| 1,973,402 | 9/1934 | Bohmbach | 128/614 |
| 2,255,100 | 9/1941 | Brady | 128/614 |
| 3,861,398 | 1/1975 | Leydecker | 128/615 |

FOREIGN PATENT DOCUMENTS

| | | | |
|---|---|---|---|
| 875466 | 3/1953 | Fed. Rep. of Germany | 128/615 |
| 436435 | 3/1912 | France | 128/613 |
| 1004501 | 3/1952 | France | 128/614 |

*Primary Examiner*—John D. Yasko

*Attorney, Agent, or Firm*—Kirschstein, Kirschstein, Ottinger & Cobrin

[57] ABSTRACT

A thin, light-weight flexible orthotic device which has a therapeutic portion and a non-therapeutic portion. The therapeutic portion is shaped and contoured to engage a human foot and consists of: a distal forefoot supporting region; a proximal heel supporting region; and a medial arch supporting region. The non-therapeutic portion is a cut-out segment positioned laterally to the therapeutic portion. The orthopedic device includes posting material therein which supports a user's foot and control excessive midtarsal and subtalar pronation of the foot.

12 Claims, 8 Drawing Figures

FIG. 4
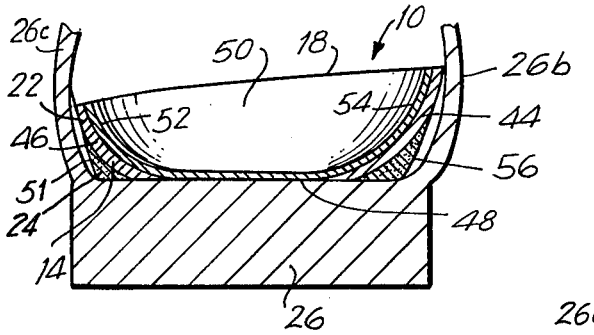
FIG. 5
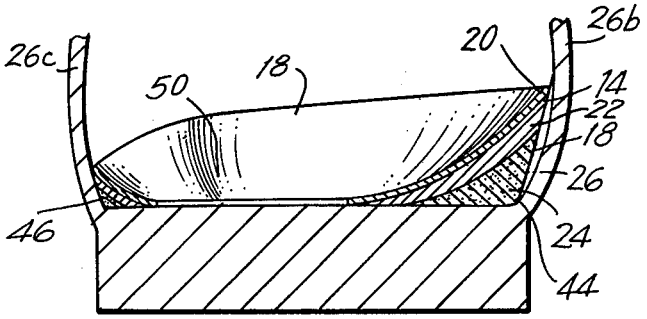
FIG. 6
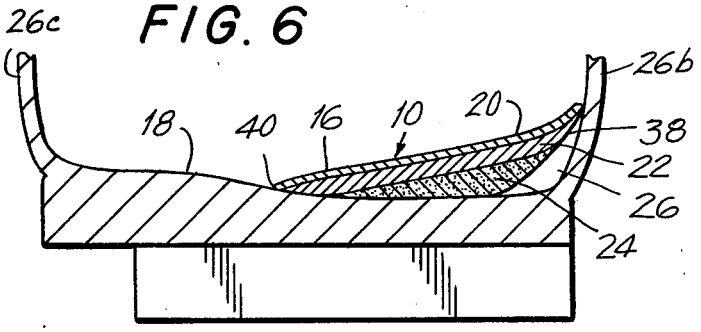
FIG. 7
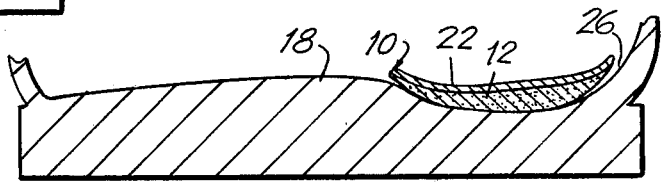
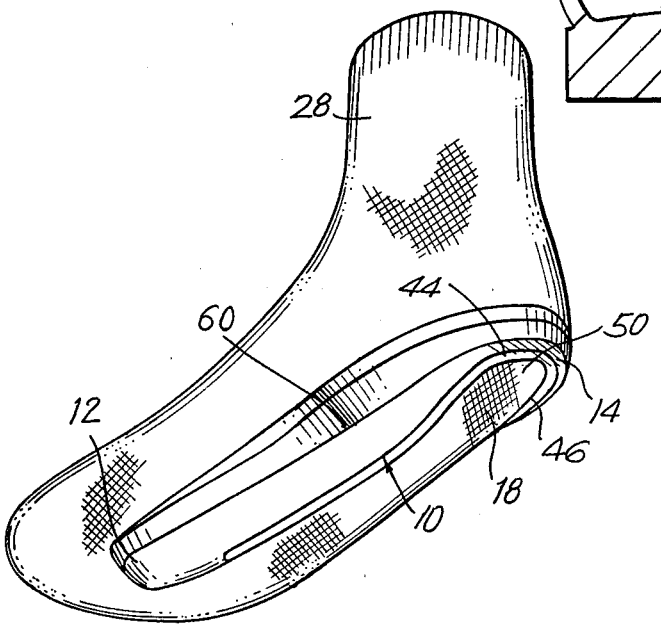
FIG. 8

THIN, LIGHT-WEIGHT FLEXIBLE ORTHOPEDIC DEVICE

BACKGROUND OF THE INVENTION

1. Field of the Invention

A thin, light-weight flexible orthopedic device.

2. Description of the Prior Art

Orthopedic devices which are made to order for a particular person are known in the art. These devices are generally, hand fitted by a podiatrist or other appropriate professional to conform to the shape and contour of the person's foot when said foot is in a corrected or neutral position.

Although prior art orthopedic devices have proven to be therapeutically useful, there are several drawbacks to the currently available devices.

The majority of prior art orthopedic devices are shaped and dimensioned to support the entire plantar aspect of the user's foot, despite the fact that generally it is only necessary to support the medial portion of the plantar aspect of the foot. Constructing the devices to include an essentially unnecessary lateral portion has added unneeded weight and height to the devices which makes them less comfortable to wear and more difficult to use with certain types of shoes, e.g. women's dress shoes.

Additionally, the afore-described construction of these devices requires the device to be unnecessarily bulky which causes the foot to be positioned too high up in the shoe and hence sometimes slip out of the shoe.

U.S. Pat. No. 2,225,100 discloses an orthopedic device to be inserted into a shoe, the device being substantially U-shaped. The orthopedic device of '100 extends lengthwise from a segment for supporting a user's heel to a segment for supporting a user's arch. This device, due to its length cannot be used to correct any imbalance in a user's forefoot.

SUMMARY OF THE INVENTION

1. Objects of the Invention

It is an object of the present invention to provide an improved orthopedic device.

A further object is to provide an orthopedic device which avoids the various drawbacks of prior art orthopedic devices.

Another object is to provide an orthopedic device which is thin, light-weight and flexible.

Still a further object is to provide an orthopedic device which will easily fit into all types of shoes.

Yet another object is to provide an orthopedic device which will not cause a user's foot to be positioned too high in a shoe and hence slip therefrom.

Another object is to provide an orthopedic device which is of a length and width sufficient to correct imbalances on any portion of a user's foot.

An additional object is to provide an orthopedic device which supports the longitudinal axis of the arch and thereby reduces arch strain.

Still another object is to provide an orthopedic device with appropriate posting in the rear foot region to prevent excessive subtalar pronation.

Another object is to provide an orthopedic device with appropriate posting in the forefoot region to prevent excessive midtarsal pronation.

Yet another object is to provide an orthopedic device which compensates for excessive varus influence.

Other objects of the present invention in part will be obvious and in part will be pointed out hereinafter.

2. Brief Description of the Invention

In keeping with these objects and others which will become apparent hereinafter, one feature of the invention resides, briefly stated, in a thin, light-weight flexible orthopedic device which includes a therapeutic portion and a non-therapeutic cut-out portion.

The therapeutic portion of the device is custom fitted to a particular person. It is generally so fitted by having a person place his foot, when said foot is in a corrected or neutral position, on a moldable substance. The foot leaves an impression in the moldable substance which the podiatrist or other professional can use to make the device. Hence, the phrase "shaped and contoured to engage a human foot" when used herein refers to the shape and contour of the impression formed by the foot in its corrected or neutral position.

The therapeutic portion of the device is of one piece and consists of three general regions: a distal forefoot-supporting region; a proximal heel supporting region and a medial arch supporting region. The medial arch supporting region is situated between the forefoot or toe supporting region and the heel supporting region.

The medial arch supporting region is bounded on its innermost side by a generally straight wall means and on its outermost side by an irregularly shaped wall means, the latter defining the aforementioned non-therapeutic cut-out portion of the orthopedic device. This non-therapeutic portion is located laterally to the therapeutic portion.

The provision of a therapeutic and a non-therapeutic portion results in a half-orthopedic device or "half-thotic" which although substantially smaller, lighter and thinner than prior art full orthopedic devices provides at least as much therapeutical aid as the latter.

Pursuant to the present invention, the orthopedic device may be inserted into a user's shoe or alternatively may be attached to a user's sock. Due to the relatively small size and thin height of the device it will fit into most shoes including women's dress shoes and sandals.

The orthopedic device of the present invention provides appropriate posting in both the forefoot and rear foot areas to prevent excessive midtarsal and subtalar pronation respectively. Appropriate posting as used herein means support, said support being such as to prevent excessive abnormal and destructive movement of the foot. Additionally, the device supports the longitudinal arch of the foot and thus reduces strain of the same. The device also compensates for excessive varus influence by bringing the medial part of the foot higher than the lateral part.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 4 is a sectional view taken substantially along line 4—4 of FIG. 3;

FIG. 5 is a sectional view taken substantially along line 5—5 of FIG. 3;

FIG. 6 is a sectional view taken substantially along line 6—6 of FIG. 3;

FIG. 7 is a sectional view taken substantially along line 7—7 of FIG. 3; and

FIG. 8 is a perspective view of the orthopedic device attached to a conventional sock.

DETAILED DESCRIPTION OF THE PREFERRED EMBODIMENTS

Figure 1:
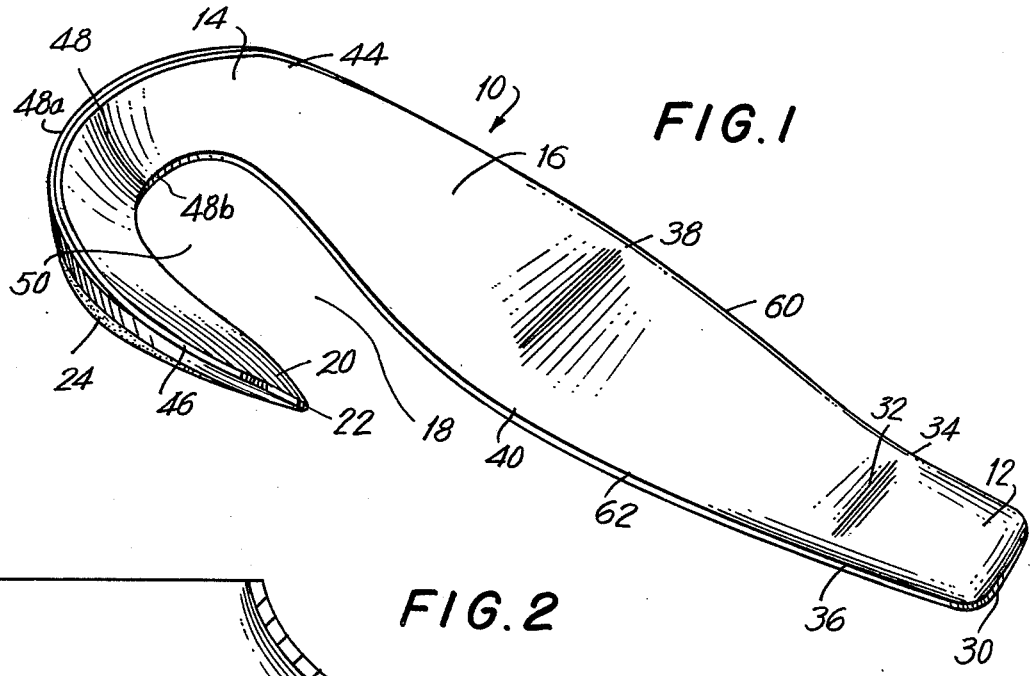
FIG. 1 is a perspective view of an orthopedic device of the present invention, the device configured to cooperate with a human right foot.
Figure 2:
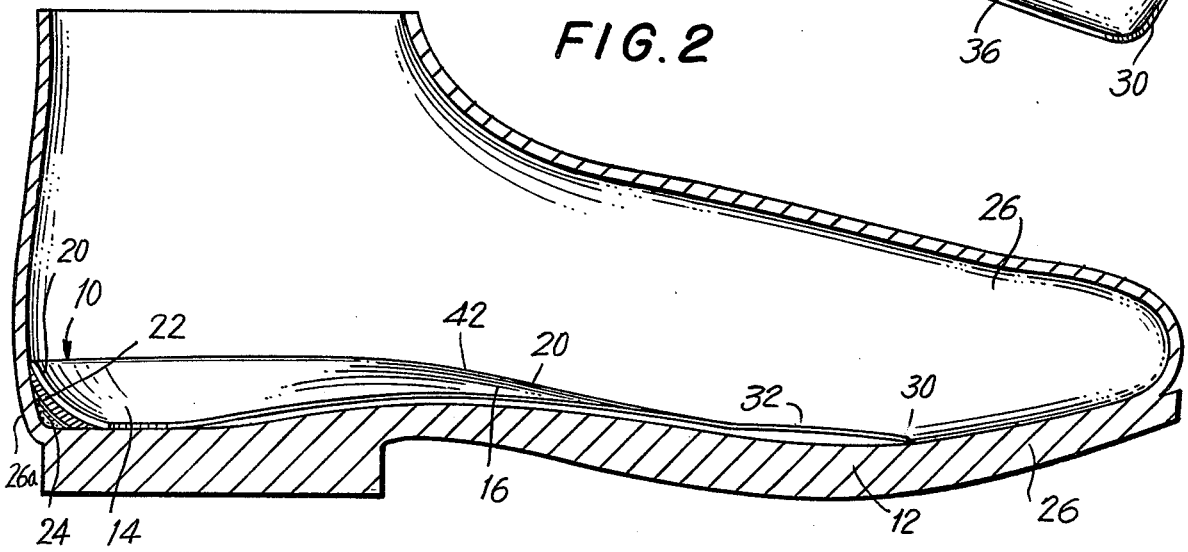
FIG. 2 is a central longitudinal sectional view of the orthopedic device of the present invention in a conventional shoe.
Figure 3:
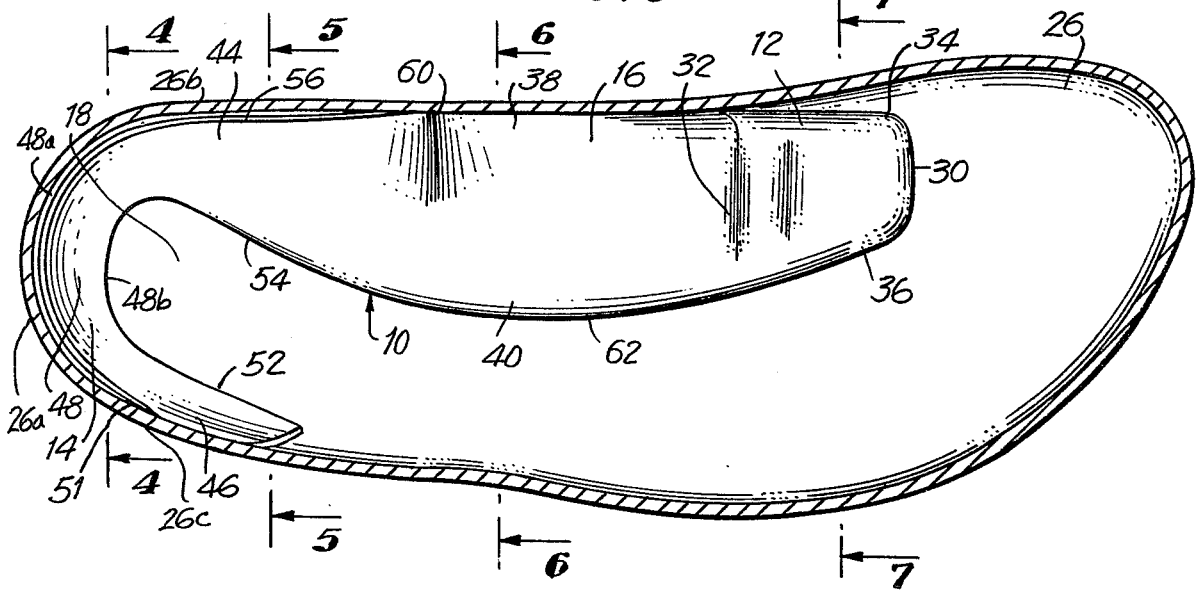
FIG. 3 is a horizontal sectional view of the orthopedic device of the present invention in a conventional shoe.

Referring now to the drawings and more particularly to FIG. 1, the reference numeral 10 denotes the orthopedic device of the present invention. Device 10, in a preferred embodiment, has a shape of an inverted question mark in plan and is characterized by the provision of a distal forefoot-supporting region 12, a proximal heel supporting region 14 and a medial arch supporting region 16. Heel supporting region 14 comprises the hook segment of the question mark. Regions 12, 14 and 16 together comprise a posted therapeutic portion of device 10. Lateral to the therapeutic portion is a cut-out, non-posted, non-therapeutic portion 18 of said device. As heretofore stated, posting as used herein refers to material in the device used to support a foot and to prevent excessive abnormal and destructive movement of same.

Device 10 includes as therapeutic, e.g. posted areas, only those areas in which it is necessary to support the foot in order to prevent said excessive abnormal and destructive movement when said foot bears weight, e.g. when the user is walking, running, etc.

Device 10 is of varying low heights and therefore both light-weight and thin, the non-therapeutic portions of the device being portions in which the device has zero height. The device 10 can best be described as a half device or half-thotic.

As best seen in FIGS. 2, 4, 5, and 6, the therapeutic portion of device 10 is composed of three layers: a top covering layer 20 made of material that wears well, preferably leather or leatherette, a middle thermoplastic layer 22, and a bottom flexible layer 24 whose bottom-most face is shaped to correspond to the shape of a shoe 26. The entire device 10 is both light-weight and comfortable. Device 10 is less bulky than prior therapeutic devices in which all regions thereof have a substantial height.

The arch supporting region 16 increases in height along its horizontal plane from an almost zero height at its most outer portion adjacent the non-therapeutic portion to a varying but always substantially low height at its most inner portion. Additionally, arch supporting region 16 gradually increases in height from an almost zero height at its most distal portion to a comparatively high point at its mid crest region 19 and then gradually decreases in height from said mid crest region to an almost zero height at its most proximal portion. Crest region 19 is of a height such as to be disposed a substantial distance above the insole of shoe 26 within which the device is worn and in contact with the inner wall of said shoe. Distal forefoot supporting region 12 increases in height longitudinally from an almost zero height at its most distal edge 30 to a varying but still extremely low height at its most proximal portion. Heel supporting region 14 increases in height from an almost zero height at the edges thereof which are immediately adjacent to the non-therapeutic portion of the device to different varying heights at its more lateral, medial and proximal portions. The entire device 10 is configured with the aforementioned different varying heights to enable the device to concomitantly support regions of the foot that need supporting while gradually allowing said device to merge with the insole of the shoe in which it is worn.

As shown in FIGS. 2–7, device 10 may be worn in shoe 26. Due to its lack of bulk, device 10 may be worn in almost any type of shoe including women's dress shoes and sandals. Alternatively, as shown in FIG. 8, device 10 may be worn attached to a user's sock 28. In the latter case, device 10 preferably is hand sewn onto the sock.

The device 10 is constructed to be of a length such that the distal edge 30 of toe receiving region 12 will be at about the sulcus of a user's toes. Toe receiving region 12 supports the user's metatarsal-phalangeal joint (the ball of the foot). As best shown in FIG. 7, toe receiving region 12 is relatively thin and narrow, and it is extremely flexible. It curves in a somewhat upwardly convex manner from both its distal edge 30 to its more proximal part 32 and from its medial edge 34 to its lateral edge 36. It is constructed with appropriate posting so that in combination with the other portions of device 10, it prevents excessive midtarsal pronation of a user's forefoot.

The arch supporting region 16 is constructed to be sufficiently wide enough to support the horizontal arch of a user's foot, moreover, it has appropriate posting to fully support the longitudinal arch of the foot and thereby prevent arch strain. The posting in arch supporting region 16, in combination with the rest of device 10 prevents both excessive midtarsal and subtalar pronation.

Arch supporting region 16 has an inner area 38 and an outer area 40 and, as best shown in FIG. 6, the outer area is thinner and lower than the inner areas. Areas 38 and 40 together provide arch supporting region with a gently sloped transverse contour. The longitudinal contour of region 16 also is shaped to support the plantar aspect of the foot and, as best shown in FIG. 6, gently slopes upwardly from the heel supporting region 14 toward generally mid-section crest region 19 and from crest region 19 downwardly toward forefoot supporting region 12.

Heel supporting region 14 preferably is generally U-shaped in plan and as heretofore stated comprises the hook section of the inverted question mark shaped device. It has an inner U-leg 44 and an outer U-leg 46 connected to one another by a posterior rounded curved section 48. Outer U-leg 46 while desirable is optional and device 10 may be constructed without same. Intermediate legs 44 and 46 is cut-out portion 50 which is part of non-therapeutic portion 18. Heel supporting region 14 is of a width approximately equal to the width of the heel of the foot.

Heel supporting region 14 is provided with appropriate posting, so that in combination with the other portions of device 10, it prevents excessive subtalar pronation. The posting in device 10 not only prevents excessive midtarsal and subtalar pronation, as heretofore described, but concomitantly compensates for excessive varus influence by holding the medial aspect of the weight bearing foot upwardly of and higher than the lateral aspect of same.

As heretofore stated, posterior section 48 is rounded so that the rounded posterior edge of the human heel can fit therein. Posterior section 48 when in shoe 26 is positioned adjacent the inner posterior wall 26*a* of the shoe. U-legs 44 and 46 are generally straight and configured to fit adjacent to the posterior portions of the shoe's medial side wall 26*b* and lateral side wall 26*c* respectively.

Lateral U-leg 46 is formed to curve convexly downward from its outermost edge 51 to its most innermost edge 52 as best shown in FIG. 4, and, as also shown in FIG. 4, inner U-leg 44 is formed to curve convexly downward from its innermost edge 54 to its outermost edge 56. Additionally, posterior section 48 is formed to curve convexly downward from its most proximal edge 48*a* to its most distal edge 48*b*.

As heretofore described, the toe, heel and arch supporting regions are all formed such as to have varying tapered heights, said varying heights tapering to a height of almost zero at those parts of the therapeutic portion of the device immediately adjacent to the non-therapeutic portion of the device and to a height of zero at the non-therapeutic portion of the device. This tapered varying height configuration of the therapeutic portion of the device, in combination with the aforementioned curvature of the various portions of the device together allow the device to be worn comfortably within a shoe and make the gap between shoe inner sole and the device imperceptable to a user when said device is worn in a shoe or attached to a sock. In other words, there is only a very slight height difference between those portions of the insole of the shoe that are not covered by the therapeutic portion of the device and the parts of the therapeutic portion of the device immediately adjacent same. In this manner, the device gradually merges with the shoe insole. As heretofore stated, the non-therapeutic portion of the device constitutes a portion of device 10 in which said device has a height of zero.

The therapeutic portion of device 10 has a generally straight medial side wall 60 and an irregularly contoured lateral side wall 62 which together define the width of said therapeutic portion and the widths of its component parts—the toe, heel and arch supporting portions. Irregularly contoured lateral side wall 62, which in combination with heel portion 14 provide the device 10 with an inverted question mark shape in plan, is exceedingly low in height.

Said irregularly contoured lateral side wall 62 defines the therapeutic portion of the device such that the therapeutic portion gradually increases in width from the most distal edge 30 of the toe supporting region to the longitudinal mid-point of the arch supporting region 16 and then gradually decreases in width from said longitudinal mid-point of arch supporting region 16 to the longitudinal mid-point of heel supporting region 14. Due to the generally U-shaped configuration of heel supporting region 14, said region, as heretofore stated, has a width such that it can support a user's heel while concomitantly containing cut-out part 50.

Positioned laterally to and defined by lateral wall 62 is non-therapeutic cut-out portion 18 of device 10. Non-therapeutic portion 18 is a void with a zero height, which in prior art orthopedic devices was filled with comparatively high, essentially non-therapeutic segments that merely added unnecessary bulk and rigidity to said devices. As heretofore stated, cut-out portion 50 is a component of non-therapeutic portion 18.

By forming device 10 to be low in height, the device is kept thin, light-weight and flexible without any diminution of its therapeutic benefits. As heretofore mentioned, the therapeutic benefits of device 10 derive from having posting in those areas in which it is necessary to support a user's foot, to prevent excessive abnormal and destructive movement of the foot when said foot bears weight. This posting support is generally only needed at the medial plantar aspect of the foot and posting at the lateral plantar aspect not only provides no advantage but is disadvantageous in that it makes a device unnecessarily bulky.

Posting is needed and provided at the lateral side of the heel in lateral U-leg 46 because in normal gait motion of the foot it is the lateral aspect of the heel that make initial rolling contact with the surface being walked upon. Additionally, lateral U-leg 46 is retained as an area with greater than zero height because it is needed to cooperate with medial U-leg 44 and posterior section 48 in forming a stabilizing portion extending widthwise across the shoe to aid in keeping the device in position within the shoe.

Device 10 is of one piece construction, arch supporting region 16 being adjacent to and situated between toe supporting region 12 and heel supporting region 14.

As heretofore stated, covering layer 20 of device 10 is preferably constituted of leather or leatherette. It is important to constitute layer 20 of a material that breathes because the plantar aspect of the foot is in contact with said layer. Even if a user wears socks, it is more comfortable if this layer is constituted of a material that breathes.

If desired, a means for adhesion may be included on the outer surface of the bottommost layer of device 10 for firmly holding the device in place in a shoe. The device will stay in place without such adhesion means during ordinary activity, but if a user is engaging in strenuous activities such as running, the adhesion means provides additional assurance that the device will not slip. Any appropriate conventional adhesive means may be used to provide the outer surface of the bottommost layer with sufficient tackiness to adhere to the inner sole of a shoe.

It is intended that the device 10 of this invention will be individually prescribed and custom-fitted to each individual so that the posting included will be of maximal advantage to each person. However, it is possible that the device 10 may be constructed to include posting that will aid a wide range of individuals and hence mass produced and sold without prescription and custom-fitting in stores.

It will be understood that each of the elements described above, or two or more together, may also find a useful application in other types of constructions differing from the types described above.

While the invention has been illustrated and described as embodied in a thin, light-weight flexible orthopedic device, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A light-weight, low profile, anti-pronation orthopedic appliance for correctably supporting a human foot, comprising:

(a) a therapeutic portion having a longitudinal axis extending lengthwise of the foot, said therapeutic portion including a distal forefoot-supporting section, a proximal heel-supporting section spaced longitudinally of the distal section, and a medial arch-supporting section located intermediate of and being of one-piece with the distal and proximal sections, (i) said distal section lying generally underneath the metatarsal head region at the medial side of the plantar aspect of the foot, and extending laterally of the longitudinal axis across the foot but terminating short of the lateral side of the plantar aspect of the foot, (ii) said proximal section lying generally underneath the inner heel region at the medial side of the plantar aspect of the foot, and extending laterally of the longitudinal axis across the foot but terminating short of the lateral side of the plantar aspect of the foot, (iii) said medial arch section lying generally underneath the arch region at the medial side of the plantar aspect of the foot, and extending laterally of the longitudinal axis across the foot but terminating short of the lateral side of the plantar aspect of the foot;

(b) a non-therapeutic portion located laterally of the therapeutic portion and lying generally underneath and longitudinally along the lateral side of the plantar aspect of the foot, said non-therapeutic portion having a lower elevation along its length as compared to the correspondingly higher elevation of the therapeutic portion along its length, to thereby negatively support the lateral side of the plantar aspect of the foot; and (c) posting means operatively mounted on the therapeutic portion, for raising the elevation of the distal, proximal and medial arch sections at the medial side of the plantar aspect of the foot as compared to the respectively corresponding lower elevations at the lateral side of the plantar aspect of the foot, to thereby correctably support the foot in an anti-pronation manner.

2. The anti-pronation orthopedic appliance as defined in claim 1, wherein the distal section has a free distal edge lying generally underneath the sulcus of the foot.

3. The anti-pronation orthopedic appliance as defined in claim 1, wherein the distal section has a shallow concave cross-section.

4. The anti-pronation orthopedic appliance as defined in claim 1, wherein the distal section has an inner medial edge and an outer lateral edge; and wherein the elevation of the inner medial edge is higher than the elevation of the outer lateral edge.

5. The anti-pronation orthopedic appliance as defined in claim 1, wherein the medial arch section extends longitudinally from the distal section in an upwardly-rising continuous manner to a raised mid-crest region lying generally underneath the arch of the foot, and thereupon in a downwardly-falling continuous manner from the raised mid-crest region to the proximal section.

6. The anti-pronation orthopedic appliance as defined in claim 1, wherein the medial arch section has an inner edge and an outer lateral edge; and wherein the medial arch section has its highest elevation at said inner medial edge, and decreases continuously from the latter along the lateral direction to the outer lateral edge which has its lowest elevation.

7. The anti-pronation orthopedic appliance as defined in claim 1, wherein the proximal section has an inner medial edge and an outer lateral edge; and wherein the proximal section has its highest elevation at said inner medial edge, and decreases continuously from the latter along the lateral direction to the outer lateral edge which has its lowest elevation.

8. The anti-pronation orthopedic appliance as defined in claim 1, wherein the distal, medial arch and proximal sections have longitudinally-extending inner medial edges which are co-linear to define a common linear medial edge, and also have curved outer lateral edges to define a common arcuate lateral edge.

9. The anti-pronation orthopedic appliance as defined in claim 1, wherein the non-therapeutic portion includes a cut-out section lying laterally of the therapeutic portion, and a stabilizing section lying generally underneath the outer heel region at the lateral side of the plantar aspect of the foot; said stabilizing section being integrally connected to the proximal section by a backheel section lying generally underneath the backheel region of the foot.

10. The anti-pronation orthopedic appliance as defined in claim 9, wherein the proximal section has an inner medial edge, and wherein the stabilizing section has an outer lateral edge, and wherein the inner medial edge of the proximal section has a higher elevation than the outer lateral edge of the stabilizing section.

11. The anti-pronation orthopedic appliance as defined in claim 9, wherein the stabilizing section is the sole part of the orthopedic appliance at the lateral side of the plantar aspect of the foot, and extends longitudinally thereof from the heel region of the foot, but not past the region laterally of the arch region of the foot.

12. The anti-pronation orthopedic appliance as defined in claim 9, wherein the cut-out section extends longitudinally of the orthopedic appliance and into a cut-out space located between the proximal section and the stabilizing section.

* * * * *